US010903556B2

(12) United States Patent
Lam et al.

(10) Patent No.: US 10,903,556 B2
(45) Date of Patent: Jan. 26, 2021

(54) UP-DOWN ZIGZAG ADDITIVE SPIRAL ANTENNA

(71) Applicant: Lockheed Martin Corporation, Bethesda, MD (US)

(72) Inventors: Tommy Lam, Apalachin, NY (US); Nicholas Gretzinger, Vestal, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 493 days.

(21) Appl. No.: 15/711,153

(22) Filed: Sep. 21, 2017

(65) Prior Publication Data

US 2018/0083350 A1 Mar. 22, 2018

Related U.S. Application Data

(60) Provisional application No. 62/397,464, filed on Sep. 21, 2016.

(51) Int. Cl.

| | |
|---|---|
| ***H01Q 1/36*** | (2006.01) |
| ***H01Q 5/328*** | (2015.01) |
| ***H01Q 9/27*** | (2006.01) |
| ***H01P 1/20*** | (2006.01) |
| ***H01Q 17/00*** | (2006.01) |
| ***H01P 5/10*** | (2006.01) |

(52) U.S. Cl.

CPC ..... *H01Q 1/36* (2013.01); *H01P 1/2005* (2013.01); *H01P 5/10* (2013.01); *H01Q 5/328* (2015.01); *H01Q 9/27* (2013.01); *H01Q 17/001* (2013.01)

(58) Field of Classification Search

CPC ..... H01Q 1/36; H01Q 5/328; H01Q 9/27; H01Q 15/00; H01Q 15/006; H01Q 15/0073; H01Q 15/008; H01P 5/10; H01P 1/2005

See application file for complete search history.

(56) References Cited

U.S. PATENT DOCUMENTS

| | | | | | |
|---|---|---|---|---|---|
| 2,856,605 | A | * | 10/1958 | Jacobsen | H01Q 9/27 343/807 |
| 3,358,288 | A | * | 12/1967 | Dubost | H01Q 9/27 343/895 |
| 3,465,346 | A | | 9/1969 | Patterson et al. | |
| 3,555,554 | A | * | 1/1971 | Kuo | H01Q 9/27 343/895 |
| 3,717,878 | A | * | 2/1973 | Mosko | H01Q 9/27 343/895 |

(Continued)

*Primary Examiner* — Dameon E Levi
*Assistant Examiner* — Jennifer F Hu
(74) *Attorney, Agent, or Firm* — Baker Botts L.L.P.

(57) ABSTRACT

A spiral antenna apparatus, which may comprise an antenna element disposed in two spiral arms in a vertical zigzag pattern. The apparatus may comprise an electromagnetic band gap cavity comprising: a ground plane, one or more layers of conductive patches, at least one pillar extending between the ground plane and a top layer of the one or more layers, and low dielectric foam disposed to fill gaps between the ground plane and the one or more layers and to fill gaps between the one or more layers. The apparatus may comprise a corrugated radio frequency choke disposed within the electromagnetic band gap cavity. At least one of the antenna element, the balun element, the electromagnetic band gap cavity, and the radio frequency choke may be fabricated using additive manufacturing.

20 Claims, 8 Drawing Sheets

(56) References Cited

U.S. PATENT DOCUMENTS

| | | | | | |
|---|---|---|---|---|---|
| 3,745,585 | A * | 7/1973 | Barbano | H01Q 1/36 | 343/792.5 |
| 4,608,572 | A * | 8/1986 | Blakney | H01Q 1/48 | 343/792.5 |
| 4,630,064 | A * | 12/1986 | Andrews | H01O 25/02 | 343/895 |
| 4,861,955 | A * | 8/1989 | Shen | H05B 6/76 | 219/699 |
| 5,990,849 | A * | 11/1999 | Salvail | H01Q 9/27 | 343/895 |
| 6,023,250 | A * | 2/2000 | Cronyn | H01Q 1/36 | 343/895 |
| 7,692,603 | B1 * | 4/2010 | Cencich, Sr. | H01Q 9/27 | 343/895 |
| 7,750,861 | B2 * | 7/2010 | Delgado | H01Q 9/27 | 343/701 |
| 8,749,451 | B1 * | 6/2014 | Zamarron | H01Q 1/36 | 343/895 |
| 8,922,452 | B1 * | 12/2014 | O'Brien | H01Q 9/27 | 343/895 |
| 9,755,317 | B2 * | 9/2017 | Grelier | H01Q 15/14 | |
| 2008/0284673 | A1 * | 11/2008 | Delgado | H01O 9/27 | 343/895 |
| 2009/0174623 | A1 * | 7/2009 | Schreider | H01Q 1/243 | 343/895 |
| 2009/0237323 | A1 * | 9/2009 | Kwak | H01Q 17/00 | 343/909 |
| 2016/0043464 | A1 * | 2/2016 | Grandfield | H01Q 1/36 | 343/848 |

* cited by examiner

UP-DOWN ZIGZAG ADDITIVE SPIRAL ANTENNA

RELATED APPLICATIONS

This application claims the benefit under 35 U.S.C. § 119(e) of U.S. Provisional Patent Application Ser. No. 62/397,464, filed on Sep. 21, 2016 and entitled "UP-DOWN ZIGZAG ADDITIVE SPIRAL ANTENNA," which is hereby incorporated herein by reference in its entirety.

BACKGROUND

Antennas are often used on mobile platforms such as airborne platforms (for example, airplanes, unmanned aerial vehicles, helicopters, and other forms of aircraft) for various purposes. Antennas may be used to find and track the location of a target, to perform electronic attack on a target, and/or to provide countermeasures against attack, beyond more typical communication uses. Using antennas on mobile platforms makes reducing the size and weight of the antennas desirable. Moreover, increasing power handling is often desirable for antennas.

SUMMARY

Some aspects include a spiral antenna apparatus, which may comprise an antenna element disposed in at least two spiral arms in a vertical zigzag pattern. The apparatus may comprise a baseplate on which the vertical zigzag pattern may be disposed. The apparatus may further comprise an electromagnetic band gap (EBG) cavity comprising: a ground plane, one or more layers of conductive patches as a patch set periodically distributed above the ground plane, at least one pillar per unit patch set extending between the ground plane and a top layer with electrical connections to all patches within the patch set, and a thin RF absorber disposed to fill a gap between the top patch layers and the baseplate of the vertical zigzag pattern.

The apparatus may comprise a radio frequency (RF) choke disposed within the electromagnetic band gap cavity, through the thin RF absorber. The RF choke may be lighter in weight than a ferrite choke. The apparatus may also comprise a balun element disposed in the RF choke. The radio frequency choke may be configured to suppress the balun element's common mode currents using an alternation in a diameter of the radio frequency choke.

At least one of the antenna element (for example, at least one spiral arm), the balun element, the electromagnetic band gap cavity, and the radio frequency choke may be fabricated using additive manufacturing. The additive manufacturing may comprise Direct Metal Laser Sintering and/or Fused Deposition Modeling.

The first spiral arm and the second spiral arm may be intertwined in orientations opposite to each other. Bottom surfaces of the antenna element may contact the baseplate.

The balun element may include two soldered wires on a first end near the spiral side that are electrically soldered to the two spiral arms in the center. A second end of the balun element may be connected to an RF coaxial connector by a coaxial-to-microstrip transition.

The first spiral arm and the second spiral arm may be disposed on a first plane. The vertical zigzag pattern of the antenna element may protrude in a direction nominally orthogonal to the first plane with a slight pitch angle.

A height of the antenna element from top to bottom of the vertical zigzag pattern of the antenna element may be proportional to a distance from a diameter offset from a center of the spiral arms or from the center.

DETAILED DESCRIPTION

The inventors have recognized and appreciated that conventional spiral antennas are significantly heavier and larger than desirable, and they have lower power handling capability than desirable. The inventors have recognized and appreciated that these issues arise for a number of reasons. First, the inventors have recognized and appreciated that the size and weight of a conventional planar spiral antenna is high because the outer diameter of the spiral is determined by the wavelength of the lowest frequency at which the antenna can operate. In particular, the minimum outer diameter is proportional to that wavelength and often must be about 60 percent of the wavelength, for a practical design that overcomes spiral arm truncation effects. To be able to operate at low frequencies (such as receiving electromagnetic waves with frequencies of about 500 megahertz), the outer diameter must be very large because the wavelength of the electromagnetic waves is very large, such as about 60 centimeters. In this example, the minimum outer diameter would need to be about 36 centimeters.

Figure 7:
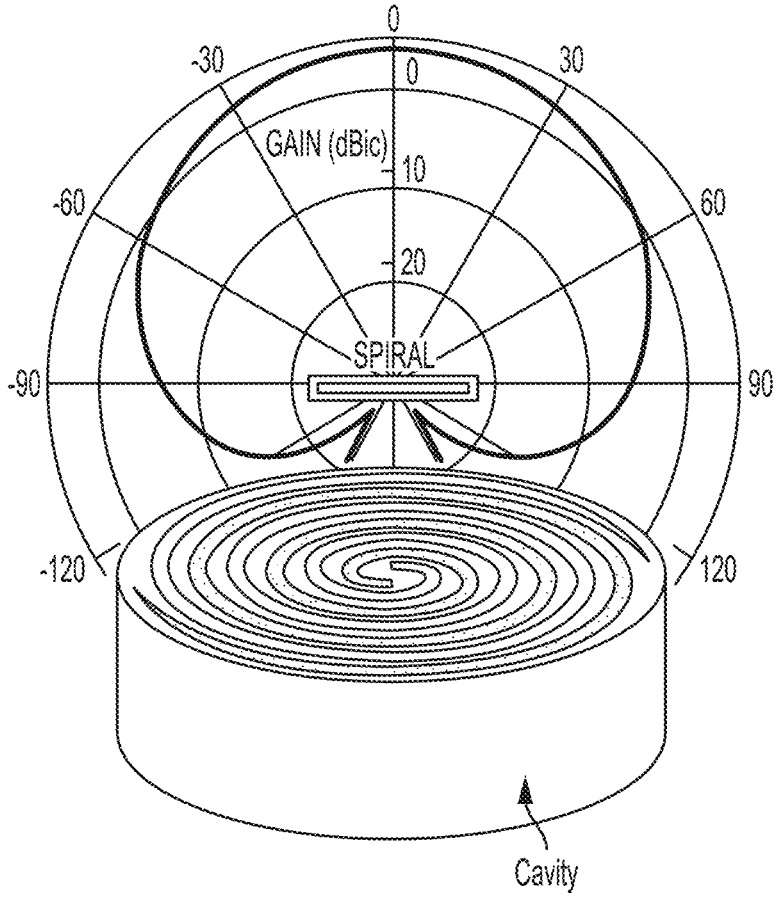
FIG. 7 depicts a conventional planar spiral antenna with a cavity.

Moreover, the inventors have recognized and appreciated that the size and weight of a conventional planar spiral antenna is high because it uses a cavity to provide a ground plane and reduce back lobe, but the minimum cavity depth is one-fourth the wavelength of the lowest frequency at which the antenna can operate. In the example above, that wavelength may be about 60 centimeters, which would require a cavity depth of 15 centimeters. FIG. 7 illustrates a conventional planar spiral antenna with a cavity.

Figure 8:
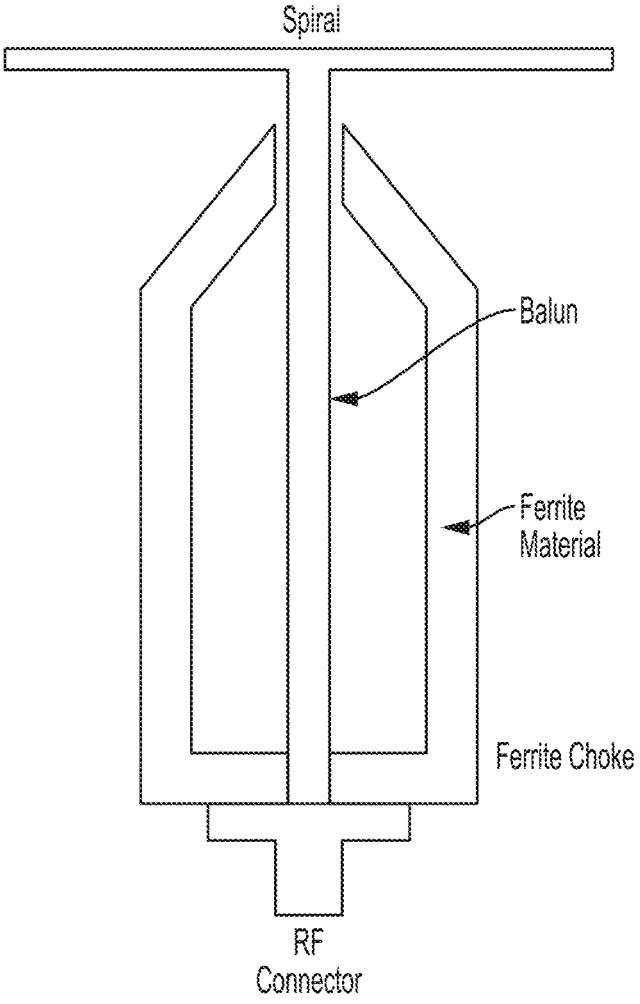
FIG. 8 depicts a conventional spiral antenna with a ferrite radio frequency choke.

Additionally, the inventors have recognized and appreciated that the size and weight of a conventional planar spiral antenna is high because it relies on a ferrite radio frequency choke enclosing the balun to provide high impedance for reducing undesirable balun common mode strength. Balun common mode can cause higher order spiral modes, which can distort performance of the antenna. FIG. 8 illustrates a conventional spiral antenna with ferrite radio frequency choke. Such a choke is far larger and heavier than is desirable for a spiral antenna, especially due to the ferrite material shown and how it is arranged conventionally. For example, the choke itself can weigh about 0.7 pounds.

The inventors have recognized and appreciated that significantly reduced weight and size as well as significant increased power handling capability may be attained by using an up-down zigzag spiral antenna, especially by fabricating the spiral antenna and/or other components of the antenna apparatus using additive manufacturing. In some embodiments, the antenna apparatus described herein may be about 4 inches wide, 4 inches tall, and 2.5 inches deep, and may be about 0.7 pounds, providing about one-third the volume and one-half the weight of a conventional spiral antenna, all at lower cost than a conventional spiral antenna.

Examples of implementations are discussed below, but it should be appreciated that embodiments are not limited to operating in accordance with any of these illustrative embodiments, as other embodiments are possible. Further, it should be appreciated that while some embodiments are described as being implemented as part of an aircraft, embodiments are not limited to being implemented with any particular form of vehicle or structure.

Figure 1:
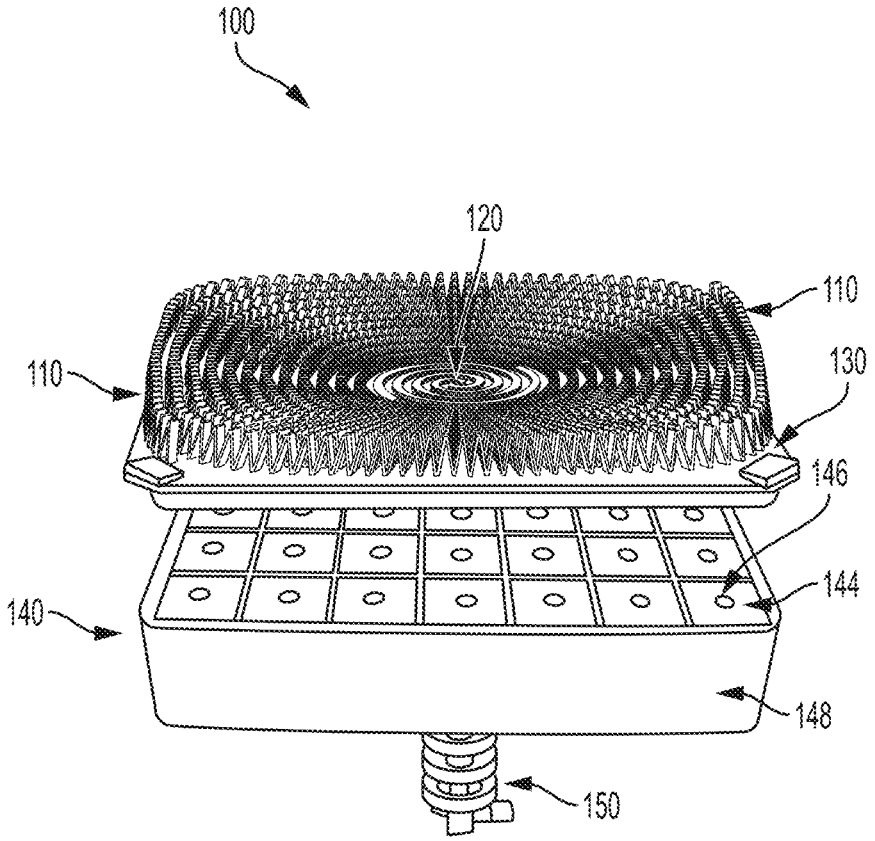
FIG. 1 is a perspective view of exemplary components of an exemplary spiral antenna apparatus 100, in accordance with some embodiments.

FIG. 1 shows an exemplary spiral antenna apparatus 100 according to some embodiments. Apparatus 100 may include an antenna element 110, which may be configured to receive and transmit electromagnetic waves. The inventors have recognized and appreciated that unlike some embodiments, a conventional spiral antenna may primarily receive RF signals or may be restricted to transmitting at very low power (such as at 2 watts).

Figure 3A:
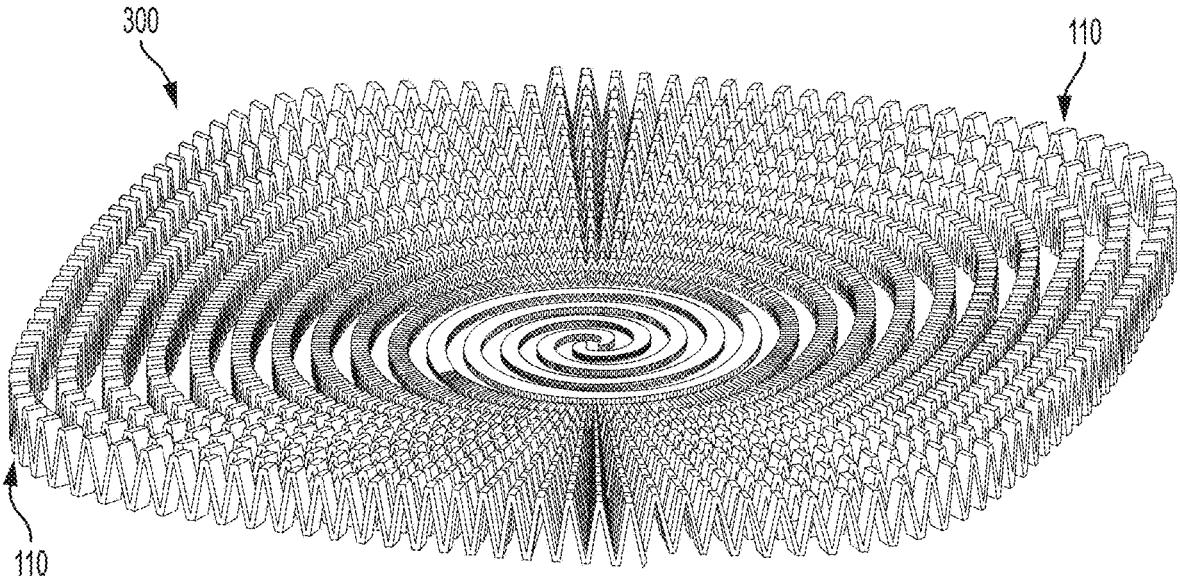
FIG. 3A is a perspective view of an exemplary antenna element 110, in accordance with some embodiments.
Figure 3B:
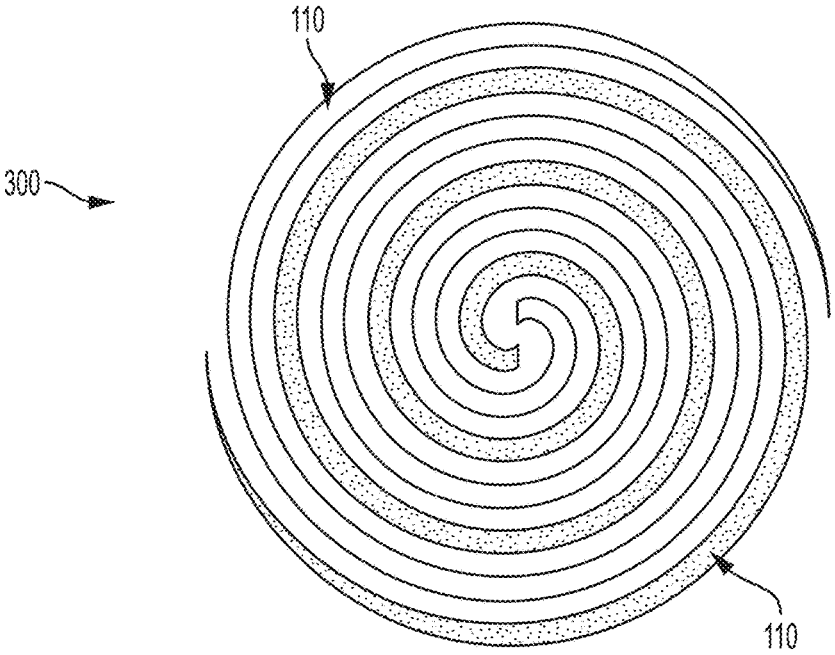
FIG. 3B is a top plan view of an exemplary antenna element 110, in accordance with some embodiments.

According to some embodiments, antenna element 110 may be disposed in a first spiral arm in an up-down (or "vertical") zigzag pattern, as shown in FIGS. 1 and 3A. Additionally, antenna element 110 may be disposed in a second spiral arm in an up-down or vertical zigzag pattern. For example, as the first and second spiral arms extend along a first plane on which they are disposed, from their closest point at the center to the outside, the antenna element 110 may protrude in zigzags up and down, in directions orthogonal to the first plane. Alternatively, any number of spiral arms may be included in some embodiments, such as 4, 5, 6, and so on.

The inventors have recognized and appreciated that an up-down zigzag pattern for some embodiments may significantly reduce the size of the antenna apparatus 100 relative to a conventional spiral antenna because, given the same diameter as a conventional spiral antenna, some embodiments of the up-down zigzag may provide a longer path for electromagnetic currents. This longer path may increase inductance along the spiral arms. As a result, the currents may have more traveling phase and achieve 360 degrees of phase at a smaller diameter of the spiral because they have travelled through more path than they would have in a conventional spiral antenna. Moreover, the inventors have recognized and appreciated that this may be accomplished without significant performance degradation.

The inventors have recognized and appreciated that an up-down zigzag pattern for some embodiments may also provide more size reduction than a conventional planar sawtooth spiral antenna because it may efficiently utilize the vertical volume, reducing the spiral line to line capacitance which, in the planar sawtooth, would adversely reduce the desirable inductance. That is, some embodiments of the up-down zigzag pattern may provide more desirable inductance from the up zigzag path, and thus reduce the size of the spiral antenna relative to the convention planar sawtooth spiral antenna.

The inventors have recognized and appreciated that an up-down zigzag pattern for some embodiments may create a larger cross-section in the elements than a conventional planar or printed-circuit spiral. For example, the cross-section of the zigzag may be about 0.02 inches high by 0.06 inches wide. This larger cross-section may create less resistance (for example, in Ohms) in the elements, reducing dissipation of power and the rise in temperature. As a result, the apparatus 100 according to some embodiments may have a significantly higher power handling capability than conventional spiral antennas.

Figure 2:
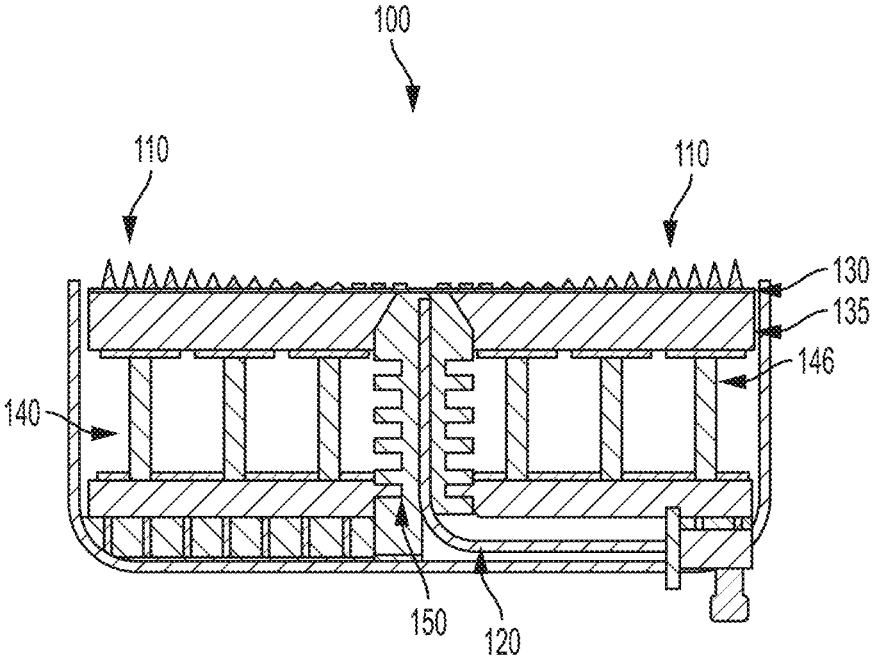
FIG. 2 is a cross-sectional view of an exemplary spiral antenna apparatus 100, in accordance with some embodiments.
Figure 4:
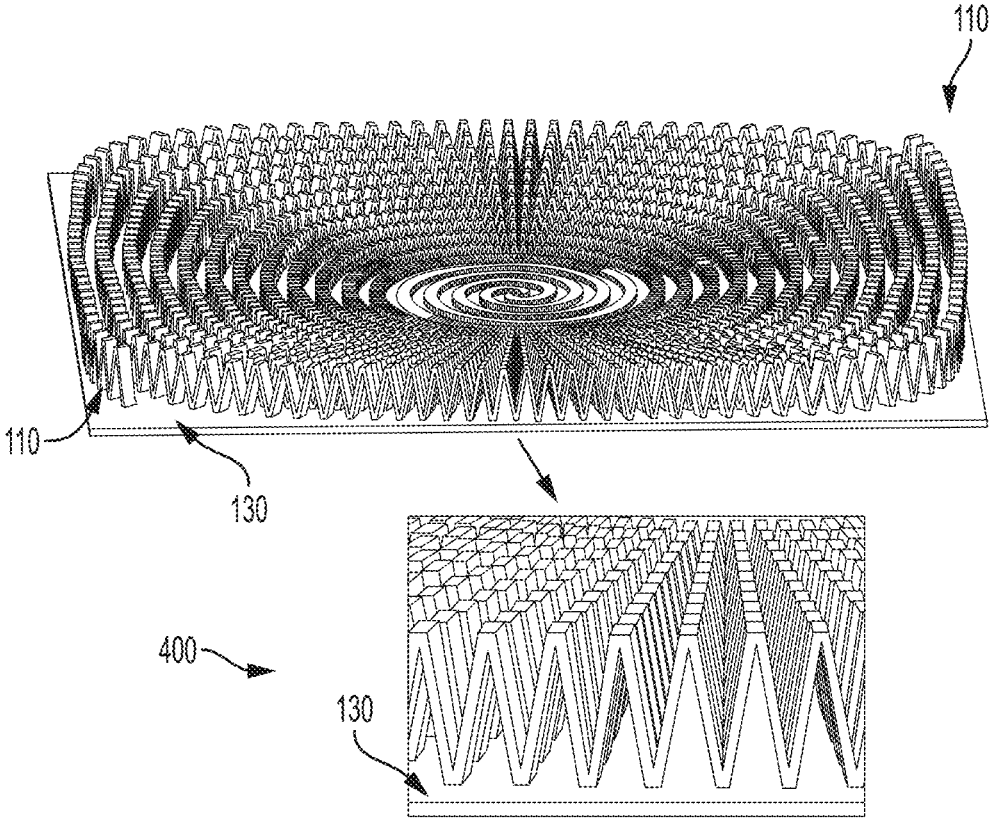
FIG. 4 is a perspective view of an exemplary antenna element 110 and an exemplary baseplate 130, in accordance with some embodiments.

According to some embodiments, the height of the antenna element 110 from top to bottom of the vertical zigzag pattern of the antenna element 110 may be proportional to the distance from a diameter offset from the center of the spiral arms or to the distance from the center of the first spiral. FIGS. 1, 2, and 4 show examples of these height proportions. For example, the zigzag height may be zero from the spiral center to a certain diameter, and gradually and gently increasing from a starting diameter to the full size of the spiral. The inventors have recognized and appreciated that this zero height near the spiral center up to the starting diameter may provide normal spiral high frequency operations where spiral size may not be a challenge. After the starting diameter, as the spiral arms gets larger and further away from the center, the zigzag height may be gradually taller. The inventors have recognized and appreciated that this zigzag progressive height starting from a pre-determined diameter along the spiral arms may provide minimum obstructions to the spiral high frequency operations that occur near the spiral center. Furthermore, this progressive height design may allow spiral size reduction operating at low frequency, and combined with the progressive spiral height design, may provide both low and high frequency broadband operations.

The inventors have recognized and appreciated that these height proportions according to some embodiments may balance positive and negative effects on low and high frequencies. For example, high frequencies may benefit from low heights near the spiral center region where spiral arms physically operates at high frequencies. By this progressive zigzag height design, and low frequencies may favorably benefit from high heights due to a longer path length near the spiral edge regions where spiral arms physically operate at low frequencies.

According to some embodiments, apparatus 100 may include a baseplate 130, as shown in FIGS. 1, 2, and 4. Additionally, the vertical zigzag pattern of the antenna element 110 may be disposed on baseplate 130, as shown. According to some embodiments, the first spiral arm and the second spiral arm may be intertwined in orientations opposite to each other. Additionally, bottom surfaces of the antenna element 110 may contact the baseplate 130.

The inventors have recognized and appreciated that an up-down zigzag pattern for some embodiments may cause the contact area between the baseplate 130 and the antenna element 110 to be smaller. For example, the contact area may be about 0.02 inches by 0.06 inches. As a result, heat may not be concentrated on the baseplate 130, but rather may be spread out, further increasing the power handling capability over conventional spiral antennas. For example, some embodiments may handle about 20 watts, which may increase the power handling of a conventional spiral antenna by a factor of 10, and some embodiments may handle 50 watts or more.

According to some embodiments, apparatus 100 may include an electromagnetic band gap (EBG) cavity 140

Figure 5:
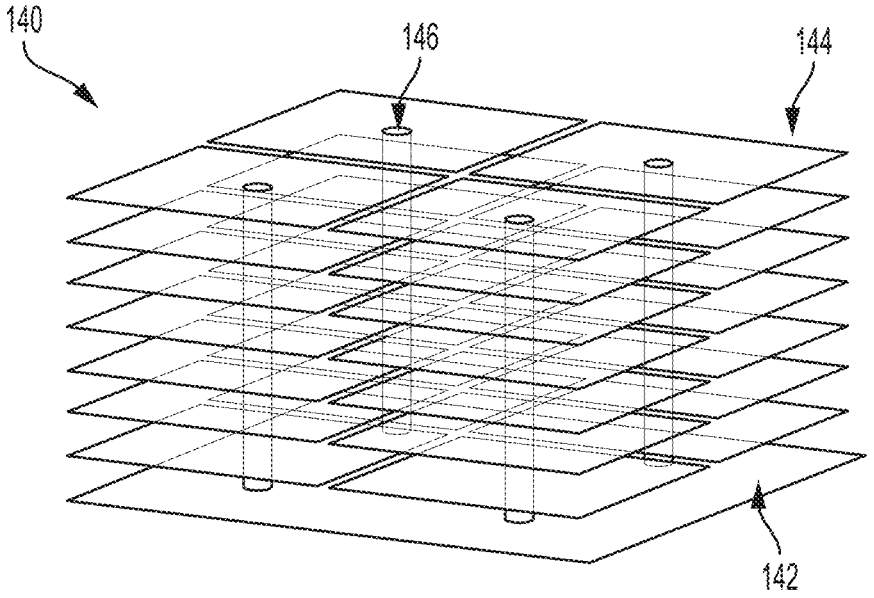
FIG. 5 depicts an exemplary electromagnetic band gap cavity 140, in accordance with some embodiments.

(shown in FIGS. 1, 2, and 5), which may be disposed opposite the baseplate 130 relative to the antenna element 110, as shown in FIG. 1. The electromagnetic band gap cavity 140 may, in some embodiments, be a metamaterial and may include a ground plane 142, one or more layers 144 of conductive patches, at least one pillar 146 extending between the ground plane 142 and a top layer of the one or more layers 144, and low dielectric foam 148 disposed to fill gaps between the ground plane 142 and the layers 144, between the layers and the baseplate 130, and between the layers 144 themselves. The layers 144 may be uniformly spaced, as shown in FIG. 5.

The inventors have recognized and appreciated that an electromagnetic band gap cavity 140 according to some embodiments may significantly reduce the size of the antenna apparatus 100 relative to a conventional spiral antenna because the electromagnetic band gap cavity 140 may have significantly smaller depth than the cavity of a conventional spiral antenna. For example, the depth of the electromagnetic band gap cavity 140 in some embodiments may be only one-tenth the wavelength of the lowest frequency at which the antenna can operate, compared to the one-fourth the wavelength required by the cavity for a conventional spiral antenna.

According to some embodiments, apparatus 100 may include a high frequency absorber 135, as shown in FIG. 2. The inventors have recognized and appreciated that the combined use of a high frequency absorber and the EBG cavity 140 may provide an antenna depth reduction over broadband frequencies.

According to some embodiments, the ground plane 142 of the electromagnetic band gap cavity 140 may reduce back lobe by in phase reflection, with a reflection phase of plus or minus 90 degrees from over 0.5 to 1 gigahertz. Additionally, the absorber 135 of the electromagnetic band gap cavity 140 may be a foam absorber that reduces spiral back lobe by reducing back lobe signal over 1 gigahertz. The inventors have recognized and appreciated that the absorber 135 may have reduced thickness because of the higher frequencies above 1 gigahertz. According to some embodiments, the electromagnetic band gap cavity 140 with the absorber 135 may provide broadband performance with broadband back lobe reduction.

Figure 6:
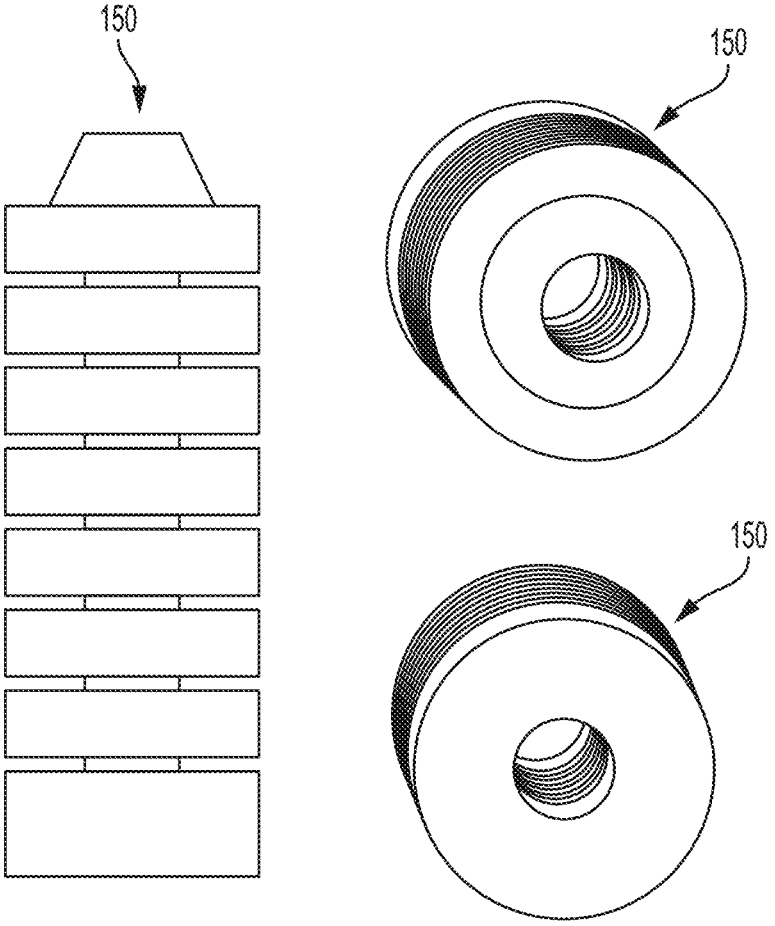
FIG. 6 depicts an exemplary radio frequency choke 150, in accordance with some embodiments.

According to some embodiments, apparatus 100 may include a radio frequency (RF) choke 150 (shown in FIGS. 1, 2, and 6), which may be disposed within the electromagnetic band gap cavity 140, as shown in FIG. 2. In some embodiments, a balun (for example, balun element 120) may be disposed within the radio frequency choke 150, as shown in FIG. 2. In some embodiments, both the first and the second spiral arm of the antenna element 110 may be fed by balun element 120. Additionally, balun element 120 may include two soldered wires on a first end near the spiral side that are electrically soldered to the two spiral arms in the center. A second end of the balun element 120 may be connected to an RF coaxial connector by a coaxial-to-microstrip transition. Additionally, the RF choke 150 may be configured to suppress the common mode of balun element 120 and/or filter a range of frequencies using an alternation in the diameter of the RF choke 150. For example, the RF choke 150 may be corrugated.

The inventors have recognized and appreciated that an alternation in the diameter of the RF choke 150, with the diameter larger in some places than others, may provide high impedance at the larger diameter and low impedance at the smaller diameter around the balun element 120. This may be because the balun common mode (2 conductor lines, but at equal phase) can essentially be considered as an equivalent center conductor and the RF choke 150 as the outer shield conductor in a standard coaxial transmission system. The larger diameter of the RF choke 150 may cause the balun element 120 common mode to act like a series inductor, while the smaller diameter may act like a shunt capacitor. This may produce the effect of multi-section series inductors and shunt capacitors and thereby the effect of a low pass filter, which may attenuate the common mode signal in the frequency range of about 0.5 to 18 gigahertz. In some embodiments, the larger and smaller diameters may not affect the desirable differential signal of the balun element 120. The inventors have recognized and appreciated that the RF choke 150 in some embodiments may provide a superior choke to that of a conventional ferrite choke (which may also provide high impedance, and thus attenuation of the balun element 120 common mode at the expense of more weight) and enhance radiation from the apparatus 100, with lighter weight.

The inventors have recognized and appreciated that additive manufacturing (sometimes referred to as three-dimensional printing, although not limited thereto) may significantly reduce the cost, weight, and size of various components of a spiral antenna. For example, in some embodiments, the antenna element 110, the balun element 120, the electromagnetic band gap cavity 140, and/or the RF choke 150 may be fabricated using additive manufacturing. The additive manufacturing may specifically be Direct Metal Laser Sintering (DMLS), which may be used to fabricate metal components such as the antenna element 110 and the balun element 120 in some embodiments. According to some embodiments, the additive manufacturing may specifically be Fused Deposition Modeling (FDM), such as for the RF choke 150.

According to some embodiments, additive manufacturing may be used to fabricate the zigzag of the elements with larger cross-section, without waste materials. The inventors have recognized and appreciated that a conventional spiral antenna may yield significant waste materials from the etching process in order to get a cross-section equivalent to some embodiments. Due in part to this reduction of waste materials, the inventors have recognized and appreciated that the cost of some embodiments may be significantly reduced relative to a conventional spiral antenna.

Having thus described several aspects of at least one embodiment of this application, it is to be appreciated that various alterations, modifications, and improvements will readily occur to those skilled in the art.

Such alterations, modifications, and improvements are intended to be part of this disclosure, and are intended to be within the spirit and scope of the application. Further, though advantages of the present application are indicated, it should be appreciated that not every embodiment will include every described advantage. Some embodiments may not implement any features described as advantageous herein and in some instances. Accordingly, the foregoing description and drawings are by way of example only.

Various aspects of the embodiments described above may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Having thus described several aspects of at least one embodiment, it is to be appreciated that various alterations, modifications, and improvements will readily occur to those skilled in the art. Such alterations, modifications, and improvements are intended to be part of this disclosure, and are intended to be within the spirit and scope of the principles described herein. Accordingly, the foregoing description and drawings are by way of example only.

What is claimed is:

1. A spiral antenna apparatus, the apparatus comprising:
an antenna element disposed in at least two spiral arms in a vertical zigzag pattern;
a balun electrically coupled to the at least two spiral arms of the antenna element; and
a radio frequency choke at least partially surrounding the balun, the radio frequency choke configured to attenuate a common mode of the balun using an alternation in a diameter of the radio frequency choke.

2. The apparatus of claim 1, wherein:
the at least two spiral arms are intertwined in orientations opposite to each other.

3. The apparatus of claim 1, wherein:
the at least two spiral arms are disposed on a first plane, and
the vertical zigzag pattern of the antenna element protrudes in a direction substantially orthogonal to the first plane at a pitch angle.

4. The apparatus of claim 1, further comprising:
an electromagnetic band gap cavity comprising:
a ground plane;
one or more layers of conductive patches;
at least one pillar extending between the ground plane and a top layer of the one or more layers of conductive patches; and
a radio frequency absorber disposed to fill at least one gap adjacent the one or more layers of conductive patches.

5. The apparatus of claim 4, wherein:
the radio frequency choke is disposed within the electromagnetic band gap cavity.

6. The apparatus of claim 4, wherein:
at least one of the at least two spiral arms, the electromagnetic band gap cavity, and/or the radio frequency choke are fabricated using additive manufacturing, wherein the additive manufacturing comprises Direct Metal Sintering and/or Fused Deposition Modeling.

7. The apparatus of claim 1, wherein:
a height of the antenna element from top to bottom of the vertical zigzag pattern of the antenna element is proportional to a first distance from a center of the at least two spiral arms or to a second distance from an offset from the center.

8. The apparatus of claim 1, further comprising:
a baseplate on which the vertical zigzag pattern is disposed.

9. The apparatus of claim 8, wherein:
the antenna element comprises at least two bottom surfaces that contact the baseplate.

10. The apparatus of claim 1, the radio frequency choke comprising:
a plurality of first portions each having a first diameter centered about the balun; and
a plurality of second portions each having a second diameter centered about the balun, the first diameter being smaller than the second diameter.

11. A method of manufacturing a spiral antenna apparatus, the method comprising:
fabricating an antenna element in at least two spiral arms in a vertical zigzag pattern;
electrically coupling a balun to the at least two spiral arms of the antenna element; and
fabricating a radio frequency choke that is configured to at least partially surround the balun and to attenuate a common mode of the balun, the radio frequency choke having an alternation in a diameter of the radio frequency choke.

12. The method of claim 11, wherein:
fabricating the antenna element comprises fabricating the at least two spiral arms intertwined in orientations opposite to each other.

13. The method of claim 11, wherein:
fabricating the antenna element comprises fabricating the at least two spiral arms on a first plane such that the vertical zigzag pattern of the antenna element protrudes in a direction substantially orthogonal to the first plane at a pitch angle.

14. The method of claim 11, further comprising:
fabricating an electromagnetic band gap cavity at least by fabricating:
a ground plane;
one or more layers of conductive patches;
at least one pillar extending between the ground plane and a top layer of the one or more layers of conductive patches; and
a radio frequency absorber disposed to fill at least one gap adjacent the one or more layers of conductive patches.

15. The method of claim 14, further comprising:
fabricating the radio frequency choke disposed within the electromagnetic band gap cavity.

16. The method of claim 15, wherein:
fabricating at least one of the at least two spiral arms, the electromagnetic band gap cavity, and/or the radio frequency choke comprises using additive manufacturing.

17. The method of claim 16, wherein:
using additive manufacturing comprises using Direct Metal Laser Sintering and/or Fused Deposition Modeling.

18. The method of claim 11, wherein:
fabricating the antenna element comprises fabricating the antenna element such that a height of the antenna element from top to bottom of the vertical zigzag pattern of the antenna element is proportional to a first distance from a center of the at least two spiral arms or to a second distance from an offset from the center.

19. The method of claim 11, wherein:

fabricating the antenna element comprises fabricating the antenna element with a baseplate on which the vertical zigzag pattern is disposed and with at least two bottom surfaces that contact the baseplate.

20. A spiral antenna apparatus, the apparatus comprising:

an antenna element disposed in at least two spiral arms in a vertical zigzag pattern;

a balun electrically coupled to the at least two spiral arms of the antenna element;

an electromagnetic band gap cavity; and a radio frequency choke disposed within the electromagnetic band gap cavity and at least partially surrounding the balun, the radio frequency choke configured to attenuate a common mode of the balun using an alternating diameter of the radio frequency choke.

* * * * *